United States Patent [19]

Tate

[11] Patent Number: 4,884,944

[45] Date of Patent: Dec. 5, 1989

[54] COMPRESSOR FLOW FENCE

[75] Inventor: David L. Tate, Stratford, Conn.

[73] Assignee: Avco Corporation, Providence, R.I.

[21] Appl. No.: 241,417

[22] Filed: Sep. 7, 1988

[51] Int. Cl.[4] ..... F04D 27/02

[52] U.S. Cl. ..... 415/156; 415/157; 415/166; 415/181; 415/914

[58] Field of Search ..... 415/DIG. 1, 181, 147, 415/150, 151, 156, 157, 158, 159, 166

[56] References Cited

U.S. PATENT DOCUMENTS

| | | | |
|---|---|---|---|
| 2,861,774 | 11/1958 | Buchi | 415/150 |
| 3,841,790 | 10/1974 | Stein et al. | 415/159 |
| 3,904,309 | 9/1975 | Keetley | 415/148 |
| 4,023,350 | 5/1977 | Hovan et al. | 415/DIG. 1 |
| 4,067,661 | 1/1978 | Gebhart et al. | 415/118 |
| 4,086,022 | 4/1978 | Freeman et al. | 415/119 |
| 4,363,596 | 12/1982 | Watson et al. | 415/1 |
| 4,383,798 | 5/1983 | Schucker | 415/150 |
| 4,387,563 | 6/1983 | Bell, III | 60/39.25 |
| 4,389,158 | 6/1983 | Nakanishi | 415/148 |
| 4,431,374 | 2/1984 | Benstein et al. | 415/211 |
| 4,586,870 | 5/1986 | Hohlweg et al. | 415/1 |
| 4,688,986 | 8/1987 | Schucker | 415/150 |
| 4,802,817 | 2/1989 | Tyler | 415/157 |

*Primary Examiner*—Robert E. Garrett
*Assistant Examiner*—John T. Kwon
*Attorney, Agent, or Firm*—Perman & Green

[57] ABSTRACT

A flow fence for a turbo fan jet engine, as taught by Stein et al. in U.S. Pat. No. 3,841,790, is modified by the provision of serrations about its internal circumference. Thus, when the modified flow fence is inserted into or removed from the flow field, a more gradual transition occurs in the flow thereby improving surge margins.

12 Claims, 3 Drawing Sheets

COMPRESSOR FLOW FENCE

FIELD OF THE INVENTION

The present invention relates to gas turbine engine compressors and more particularly to devices for controlling compressor surge.

BACKGROUND OF THE INVENTION

In recent years what is known as a flow fence has been incorporated in gas turbine engines to prevent compressor surge. Briefly, a flow fence consists of a split ring received in an annular recess in the compressor inlet housing of a gas turbine engine. The ring has free ends which are displaceable relative to one another between a fully expanded and fully contracted position. In the fully expanded position the ring offers no resistance to flow into the compressor. In the fully contracted position it blocks flow into the compressor and more particularly to the tips of the compressor blades, thereby preventing compressor surge during certain operating conditions.

A ring of this type usually is actuated by a control system which senses particular engine parameters whose magnitude indicates proximity to a surge condition and uses these parameters to control the ring between these two positions. This is effective in simply and efficiently eliminating stall.

One of the problems with this device, however, is that it is either on or off. The sudden change in the flow path through the compressor causes step changes in power that may be annoying to an operator. It is desirable then to slowly modulate the opening of the split ring to ease the transition and prevent compressor surge and a step change in power. However, with prior art split rings it has not been possible to maintain the inner diameter of the split ring concentric with the flow passage over the entire range of travel.

In U.S. Pat. No. 3,841,790 to Stein et al, this problem was partially overcome by inclusion of a split ring in a circumferential recess in the inlet housing. Adjustment means were connected between the housing and points adjacent to the free ends of the ring for displacing the free ends relative to one another through a predetermined path to vary the reference diameter of the ring. A guide means was connected between the housing and the ring at a point midway between the points on the ring and prevented circumferential movement but permitted radial movement so that the reference diameter of the ring was maintained substantially concentric relative to the inlet housing irrespective of the variation in the reference diameter of the ring.

One problem exhibited by the Stein et al construction was, even though adjustment between "full in" and "full out" could be accomplished gradually, surge margin still suffered during retraction at high speed.

Accordingly, it is an object of the invention to provide an improved flow fence which improves surge margins in a gas turbine engine.

It is another object of the invention to provide an improved flow fence which, upon insertion and withdrawal from the flow field, exhibits a gradual effect on the flow.

SUMMARY OF THE INVENTION

In accordance with the above objects, a flow fence as taught by Stein et al, is modified by the provision of serrations about its internal circumference. Thus, when the flow fence is inserted into or removed from the flow field, a more gradual transition occurs in the flow thereby improving surge margin.

DETAILED DESCRIPTION OF THE INVENTION

Figure 1:
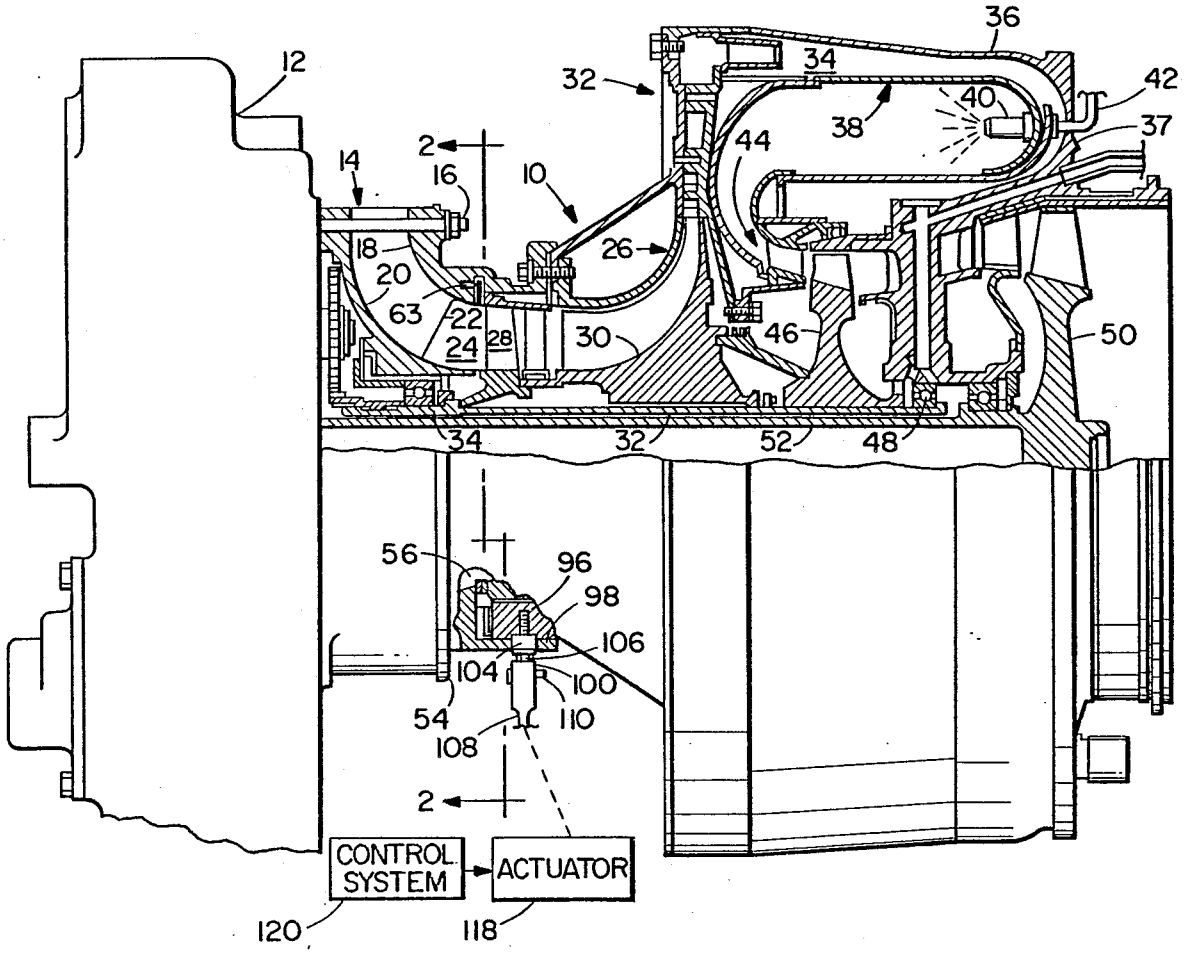
FIG. 1 is a simplified longitudinal section view of a gas turbine engine which incorporates a flow control system embodying the present invention.

FIG. 1 shows a gas turbine engine 10 comprising a compressor inlet housing 14 secured to output gearbox 12 by bolt assemblies 16. Compressor inlet housing 14 has an outer annular housing 18 and inner annular housing 20 interconnected by struts 22 to form an annular inlet flow path 24 for a compressor assembly, generally indicated at 26.

Compressor 26 includes a rotatable, bladed axial stage 28 and centrifugal impeller 30, both secured to a shaft 32 journaled at its forward end by bearing assembly 34 which is secured to housing 20. Rotation of the axial and centrifugal stages accelerates and pressurizes the air for discharge into a diffuser assembly 32. From there the air enters an annular chamber 34 defined by an outer housing 36 and annular rear strut assembly 37. An annular perforated combustor 38 is positioned with chamber 34 to receive the pressurized air and has nozzles 40 which inject fuel into the combustor 38 from a suitable source via conduit 42. The fuel/air mixture is ignited by a suitable device to produce a hot gas stream for discharge through a turbine inlet nozzle 44 across an axial-flow compressor turbine assembly 46, also mounted over shaft 32 and journaled by bearing assembly 48 that is mounted to the rear strut assembly 37. The hot gas stream passes from the compressor turbine 46 and across an axial-flow power turbine assembly 50 that is mounted on a power turbine shaft 52 extending forward to a suitable speed reduction gear set (not shown) in gearbox 12.

During operation of the engine there are certain operating conditions during which compressor surge may be encountered. In accordance with the present invention a flow control system 54 is incorporated in the compressor inlet 14 to eliminate this condition.

Figure 2:
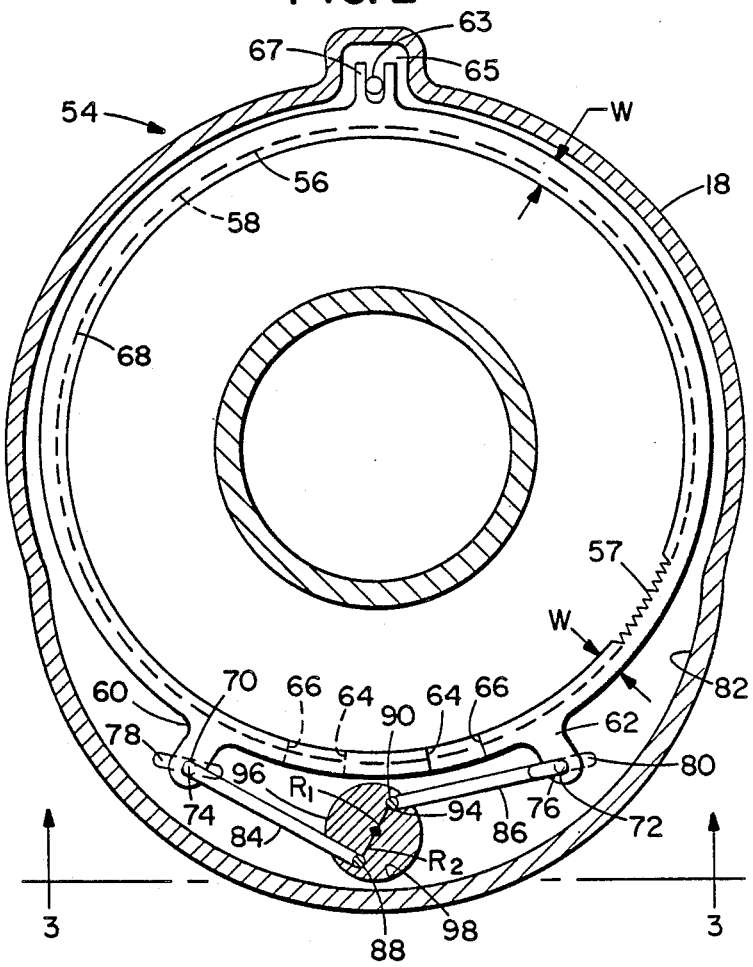
FIG. 2 is a cross-sectional view of the flow control system of FIG. 1, taken on line 2—2 of FIG. 1.
Figure 3:
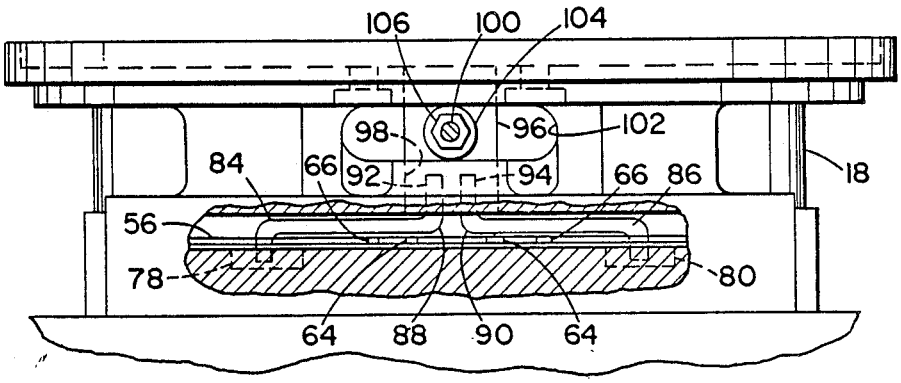
FIG. 3 is an end view of a portion of the actuation system for the flow control system of FIGS. 1 and 2, taken on line 3—3 of FIG. 2.

As shown particularly in FIGS. 2 and 3, the flow control system 54 comprises a pair of back-to-back rings 56 received in a circumferential groove 58 formed in the outer inlet housing 18. These rings each have tabs 60 and 62 adjacent their free ends 64 and 66, respectively. As is apparent in FIG. 2, the back-to-back rings have unequal lengths between the tabs 60, 62 and free ends, 64,66 respectively. This permits overlapping of the rings to prevent a gap in the flow path defined by the circular inner diameter 68 of the rings 56. For manufacturing purposes the back-to-back rings 56 are identical to one another and simply reversed so that the free ends 64 overlap one another as shown in FIG. 3. The rings may be either free or welded together in such a manner that their free ends are still movable with respect to each other.

Figure 4:
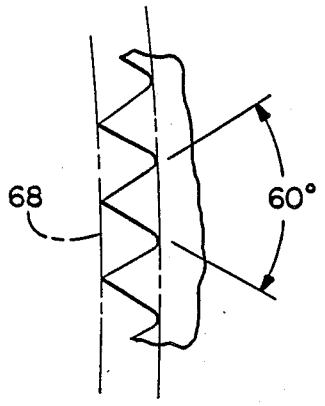
FIG. 4 is an expanded view of the serrated portions of the flow fence which comprises a portion of the flow control system.
Figure 5:
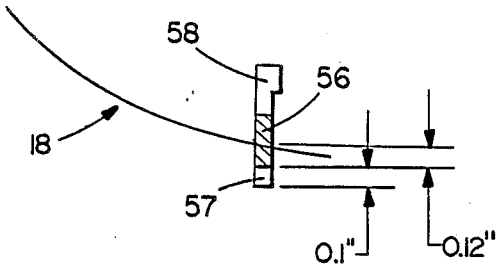
FIG. 5 is a section of a flow fence in its fully extended position.
Figure 6:
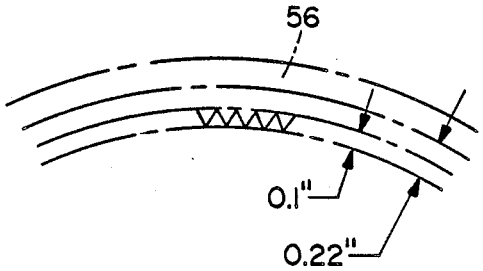
FIG. 6 is a partial plan view of the flow fence of FIG. 5.

The internal periphery of each of back-to-back rings 56 has formed therein a continuous toothed or serrated surface 57. An expanded view of these serrations/teeth is shown in FIG. 4. The serrations or teeth exhibit a crown to root distance such that when the rings are in their full radial inward orientation, approximately one quarter to one half of the exposed fence is serrated. This is further illustrated in FIGS. 5 and 6. In FIG. 5, ring 56 is shown in its fully in-stream position in relation to the inlet housing. For exemplary purposes only, suggested dimensions are shown which indicate a crown to root height of 0.1" for serrations 57 and an extension of 0.12" from the housing 18 to the roots of serrations 57. This is also further shown in the partial plan view in FIG. 6 which shows the full extension of 0.22" of ring 56 into the flow stream (from groove 58).

When rings 56 are gradually withdrawn, serrations 57 enable a smoother flow transition as they gradually disappear from the flow field. While the action of the serrations is not completely understood, it appears that they, when partially withdrawn, prevent the continuation of down stream turbulence and provide for a smoother power transition.

As shown at the upper portion of FIG. 2 a pin 63 is received in a recess 65 extending outward from groove 58 at a point which is midway around the ring 56 between the tabs 60 and 62. Tabs 67 extend radially outward from the ring 56 on either side of pin 63 so that it acts as a guide permitting radial movement of the ring 56 but not circumferential movement.

Tabs 60 and 62 have holes 70 and 72 receiving pins 74 and 76 respectively. These pins extend into slots 78 and 80 formed in the outer housing 18 in an arcuate recess 82 extending outward from circumferential groove 58. Pins 74 and 76 are respectively integral with links 84 and 86 at right angles to these pins. Links 84 and 86 have pins 88 and 90 at their opposite ends that are received in holes 92 and 94 of a cylindrical actuating element 96.

Actuating element 96 is journaled in a cylindrical bore 98 in outer housing 18 for rotation about an axis parallel to the central axis of the split ring. Actuating element 96 has a radial arm 100 threaded into it and extending through an elongated slot 102 around a portion of the circumference of outer housing 18. A relatively thick washer 104 is secured on arm 100 by a nut 106 and has an outer diameter close to the width of the slot 102 to axially position cylindrical element 96. A forked actuating link 108 is pivotally secured to arm 100 through a pin 110.

The actuating link 108 is mechanically connected to a suitable actuator 118 receiving control inputs from a control system 120 for pivoting cylindrical element 96 in response to selected control signals.

In operation, engine 10 goes through variations in compressor pressure and rpm. The control system 120 senses these conditions, as is well known in the art, and when it is necessary to vary the inner diameter 68 of the rings 56, sends a signal to actuator 118 which pivots actuating element 96. As shown in FIG. 2, rotation of element 96 in a counterclockwise direction contracts the rings 56 and rotation in a clockwise direction expands them thus varying their inner diameter 68 to form a variable area compressor inlet. The grooves 78 and 80 guide the displacement of the free ends of the rings 56 relative to one another through a predetermined path which insures that the inner diameter 68 of ring 56 is substantially coaxial with the center of the annular housing 18. The guide pin 63 permits movement of the ring in a radial direction only so as to maintain in combination with the grooves 78 and 80 the desired concentricity irrespective of variations in the inner diameter of ring 56.

The width W of the ring 56 is a maximum at its midpoint tapering to a minimum width w at its free ends. This insures that the natural shape of the inner diameter 68 of ring 56 remains circular as the ends are being displaced relative to one another. If the ring were of uniform width there would be a tendency for a greater bending adjacent the midpoint of the ring and thus distort the desired circular shape.

The radius R1 of the hole 94 is somewhat less than the radius R2 for hole 92 relative to the center of actuating element 96. This is done to compensate for the fact that hole 94 is closer to the effective center of ring 56 than is hole 92. The difference in the radius causes the holes to move uniformly relative to the center of ring 56 for a given rotation of element 96.

The predetermined path through which the free ends of the split rings travel is determined by plotting a locus of points for the free end positions which causes the center of the inner diameter of the ring to be coaxial with that for the annular housing. This is possible because the guide pin near the midpoint fixes the ring in a radial plane. The displacement of the free ends relative to one another defines the expansion or contraction of the free ends given a particular inner diameter, while their distance from the center of the housing establishes the radius which must be made equal to the radius of the midpoint of ring 56 to the center of the housing. This is easily done and once the locus of points is established the slots are formed either in the housing or in the tabs to guide the movement of the free ends through this particlar path.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A flow control system for the annular inlet housing of a compressor, said system comprising:

at least one split ring received in a circumferential recess in said housing, said ring having adjacent free ends, a circular reference diameter, and an internal circumference which is serrated; and means connected between said housing and actuation points adjacent each of the free ends of said ring for displacing said free ends toward and away from one another through a predetermined path thereby varying the reference diameter of said ring; and bringing said serrated internal circumference into and out of the flow path of said inlet housing.

2. The invention as defined in claim 1 wherein said internal circumference serrations are teeth having root to crown dimensions in the range of one quarter to one half of the dimension of said split ring which is exposed in said flow path when said free ends are displaced towards one another.

3. The invention as defined in claim 1 further comprising:

guide means connected between said housing and said ring at a point midway between the actuation points on said ring, said guide means preventing circumferential movement and permitting radial movement whereby the reference diameter of said ring is maintained substantially concentric relative to said inlet housing irrespective of the variation in said reference diameter.

4. A flow control system as in claim 3 wherein said guide means comprises:

a guide pin fixed to said housing at a point midway between the points of said rings; and a forked element extending from said ring on both sides of said pin whereby said pin forms a guide for radial movement only of said ring.

5. A flow control system as in claim 1 having a pair of split rings, each displaced by said displacing means and guided for movement by said guide means, each of said rings having the distance between one of the free ends and the respective actuating point greater than that for the other free end so that the free ends of said rings overlap one another.

6. A flow control system as in claim 5 comprising a pair of identical rings each having the same relationship between their free ends and said actuating points, said rings being fastened against one another so that the free ends having the larger of the said distances overlap one another.

7. A flow control system as in claim 1 wherein said ring has a radial width which is a maximum at its midpoint and tapers to a minimum at its free ends.

8. A flow control system as in claim 2 wherein said circumferential recess is inward facing and said reference diameter is the inner diameter of the crowns of said serrations.

9. A flow control system as in claim 1 wherein said displacing means comprises means for guiding the actuation points of said ring through said predetermined path so that the displacement of said actuation points relative to one another defines the magnitude of said reference diameter and the displacement of said actuation points relative to the center of said housing defines the concentricity of said ring.

10. A flow control system as in claim 9 wherein said displacement means comprises links having right angle output pins at one end and wherein said housing has arcuate slots receiving said output pins for guiding the actuation points through said predetermined path.

11. A flow control system as in claim 10 wherein:

the actuation points on said ring comprise tabs adjacent its free ends, said tabs having holes therethrough;

said pins extend through said holes and into said slots.

12. A flow control system as in claim 11 wherein said displacing means comprises:

input pins extending at right angles to said links at the other end of said links;

a generally cylindrical element journaled for rotation in said housing about an axis and having a pair of holes eccentric with respect to said axis, said input pins being received in said eccentric holes;

an arm extending radially from said cylindrical element to the exterior of said housing whereby pivoting of said arm rotates said cylindrical element and displaces the free ends of said ring relative to one another.

* * * * *